US005184566A

United States Patent [19]

Cochran

[11] Patent Number: 5,184,566

[45] Date of Patent: * Feb. 9, 1993

[54] BUOYANT BOAT WITH GIRDER BOX

[76] Inventor: William H. Cochran, P.O. Box 252, Exeter, R.I. 02822

[ * ] Notice: The portion of the term of this patent subsequent to May 29, 2007 has been disclaimed.

[21] Appl. No.: 541,811

[22] Filed: Jun. 21, 1990

[51] Int. Cl.[5] ..... B63B 7/00

[52] U.S. Cl. ..... 114/355; 114/364

[58] Field of Search ..... 114/343, 345, 355-357, 114/364, 267, 358, 360, 291, 68, 346; 441/43, 40, 129

[56] References Cited

U.S. PATENT DOCUMENTS

| | | | |
|---|---|---|---|
| 552,248 | 12/1945 | Hassard-Short | 114/360 |
| 1,220,876 | 3/1917 | Moore | 114/360 |
| 2,154,040 | 4/1934 | Friesendahl | 114/345 |
| 2,698,447 | 1/1955 | Potts | 114/345 |
| 2,724,132 | 11/1951 | Shoup | 114/360 |
| 3,261,038 | 7/1966 | Klepper | 114/345 |
| 3,435,470 | 4/1969 | Krenzler | 114/357 |
| 3,848,284 | 11/1974 | Livingston | 114/357 |
| 4,416,639 | 11/1983 | Gillmer | 114/364 |
| 4,498,413 | 2/1985 | Cochran | 114/345 |
| 4,660,497 | 4/1987 | Cochran | 114/345 |
| 4,724,792 | 2/1988 | Cochran | 114/345 |
| 4,928,619 | 5/1990 | cochran | 114/345 |

FOREIGN PATENT DOCUMENTS

| | | | |
|---|---|---|---|
| 141299 | 4/1920 | United Kingdom | 114/360 |

*Primary Examiner*—Joseph F. Peters, Jr.
*Assistant Examiner*—Clifford T. Bartz
*Attorney, Agent, or Firm*—Cushman, Darby & Cushman

[57] ABSTRACT

A buoyant boat with a girder box is provided. The girder box maintains the deck part and hull part of the boat in predetermined spaced apart relation and allows the transmission of forces and stresses along the length of the boat. The girder box further enables an outboard engine or an inboard engine in the form of a propeller or hydrojet to be provided. A relatively resilient buoyancy part is provided in accordance with the structure of the invention which extends peripherally of the hull and deck parts to advantageously prevent entry of water into the boat while providing the advantages of design variability, stability and puncture resistance over inflatable structures.

26 Claims, 8 Drawing Sheets

BUOYANT BOAT WITH GIRDER BOX

BACKGROUND OF THE INVENTION

The present invention relates to a boat and, more particularly, to an improved construction of a buoyant boat having a girder box support structure and relatively rigid topsides which perform a buoyancy function.

A number of aquatic vessels have been proposed and developed for use in military, commercial and recreational applications. In many conventional boats, the topsides are formed from the same rigid material as the hull. This imposes limitations on the versatility of the boat structure. Indeed, it has long been the desire of boat designers and builders to provide boats which are modular, that is formed from parts which may be manufactured at different times and/or from different materials having desired characteristics, so that the particular needs of various consumers can be accommodated. Thus, one trend has been to form the topsides of aquatic vessels from inflatable structures which are disposed around and about the periphery of the rigid hull or rigid hull portion. The inflatable structure or structures are air-containing vessels which typically are made of supported rubber or unsupported plastic film adhesively and/or mechanically secured to the rigid structure. Mechanical fasteners, however, have the disadvantage that they necessarily concentrate stress between the rigid and flexible hull portions at points and thus increase the probability of failure of the material and/or the fastening structure at those points of attachment.

Inflatable boat structures have been proposed by me in earlier U.S. patents cited herein below wherein the inflatable portions of the boat are encased within shrouds so as to increase the durability or versatility of the rigid inflatable boat and to facilitate assembly, disassembly, repair, and replacement of parts of the structure. The inclusion of bolt ropes with the shrouds further provides a line rather than points of attachment thereby further increasing the versatility and utility of the design. One construction, disclosed in my prior art U.S. Pat. No. 4,498,413, the disclosure of which is incorporated herein by this reference, involves the use of an inflatable bladder or a plurality of such bladders inside a shroud and arranged around and above the periphery of a rigid bottom module. The shroud may be removably attached to the rigid bottom module by means of a bolt rope as disclosed in my prior U.S. Pat. No. 4,660,497, the disclosure of which is incorporated herein by this reference. Thus, the resulting aquatic vessel is modular. Another modular rigid inflatable boat is disclosed in my earlier U.S. Pat. No. 4,724,792, the disclosure of which is incorporated herein by this reference.

Yet a further boat structure developed by me is disclosed in U.S. Pat. No. 4,928,619, the disclosure of which is incorporated herein by this reference, which relates, in particular, to the bottom portions of a boat wherein the deck part and the hull part are interconnected about the periphery of the boat structure by shroud-incased buoyant elements so that, preferably, the hull to deck joint typically provided peripherally of a hull part and a deck part can be eliminated. Thus, in the foregoing structure, the rigid bottom was one module, the shroud another module, and the bladder or bladders is or are another module. The bladders may be attached and/or positioned by provision through the shroud.

All boats made according to the aforementioned disclosures are, of course, unique and advantageous. That is not to say, however, that improvement thereof is not possible and indeed the present invention constitutes an improvement of my prior aquatic vessel structures.

In accordance with the specifically disclosed embodiments of the above-referenced patents, the buoyancy function, that is the function of preventing water from entering the boat, is preferably preformed by inflatable topsides which are most preferably formed from one or more bladder elements encased in a shroud. While such structures have the advantage of resilient topsides, compact storage, and interchangeable parts, such an inflatable structure requires assembly and inflation prior to use of the vessel, requires a source of fluid such as air under pressure to inflate the inflatable bladders, and is susceptible to puncture. Furthermore, the cross-sectional shape of inflatable topsides is necessarily limited to a circle.

Thus, despite the trend toward inflatable topsides, there remains a desire in the industry to provide a modular boat structure which provides the advantages of relatively resilient topsides without the disadvantages of inflatable topsides noted above.

SUMMARY OF THE INVENTION

In accordance with this invention, it has been discovered that newly available materials, particularly when combined with a girder box structure, provide more structural versatility than would otherwise be possible.

It is therefore an object of this invention to provide a boat structure wherein the buoyancy function, that is the prevention of entry of fluid into the interior of the boat, is performed by a relatively resilient structure which can be rigidly and permanently attached to the deck part and/or to the hull part, is not susceptible to puncture, and can be formed in virtually any cross-sectional shape.

It is a further object of this invention to provide a relatively resilient buoyancy element which may be but is not necessarily a material characteristically referred to as buoyant, that is exhibiting a specific gravity of less than 1.

It is yet another object of this invention to provide a resilient sided aquatic vessel having a rigid support structure for transmitting loads along at least the longitudinal axis of the boat so as to increase the strength and versatility thereof.

Thus, the present invention overcomes the deficiencies of boats having rigid topsides and the deficiencies of boats having inflatable topsides by providing a relatively resilient buoyancy part secured to at least one of the deck and hull which advantageously resists puncture while performing the buoyancy function of preventing entry of water into the vessel. The invention further provides a girder box structure disposed along and preferably between the deck part and the hull part of the vessel so as to provide a means for distributing forces between the hull part and the deck part as well as along the length of the vessel in addition to performing the a stiffening function, thereby maintaining the deck part and hull part in a predetermined configuration as well as in a predetermined spaced relation. The girder box also advantageously provides a support for either an inboard motor or an outboard motor, as desired, due to its strength and force transmitting ability.

Other objects, features, and characteristics of the present invention as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENTS

Figure 3:
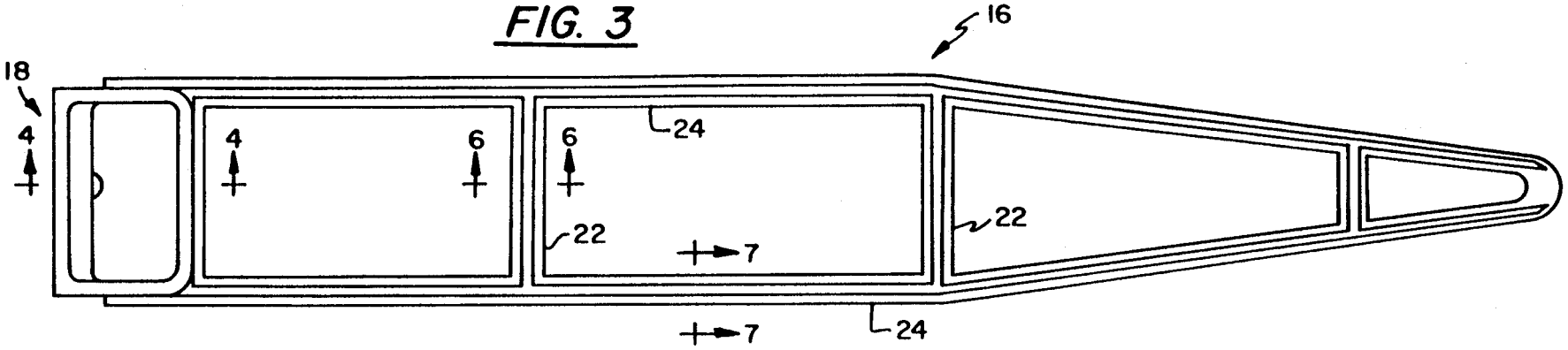
FIG. 3 is a schematic top plan view of one form of a girder box assembly provided in accordance with the present invention.
Figure 5:
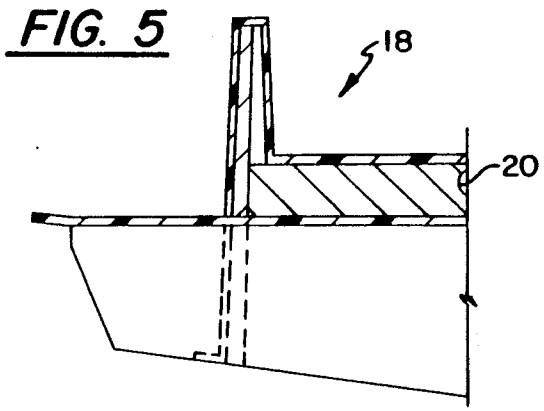
FIG. 5 is a schematic cross-sectional view taken alone line 5—5 in FIG. 4.
Figure 8:
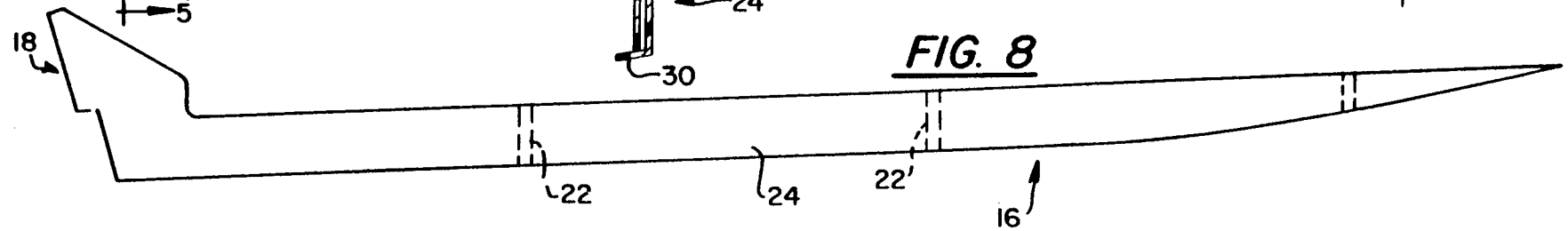
FIG. 8 is a schematic elevational view of the girder box assembly of FIG. 3.
Figure 9:
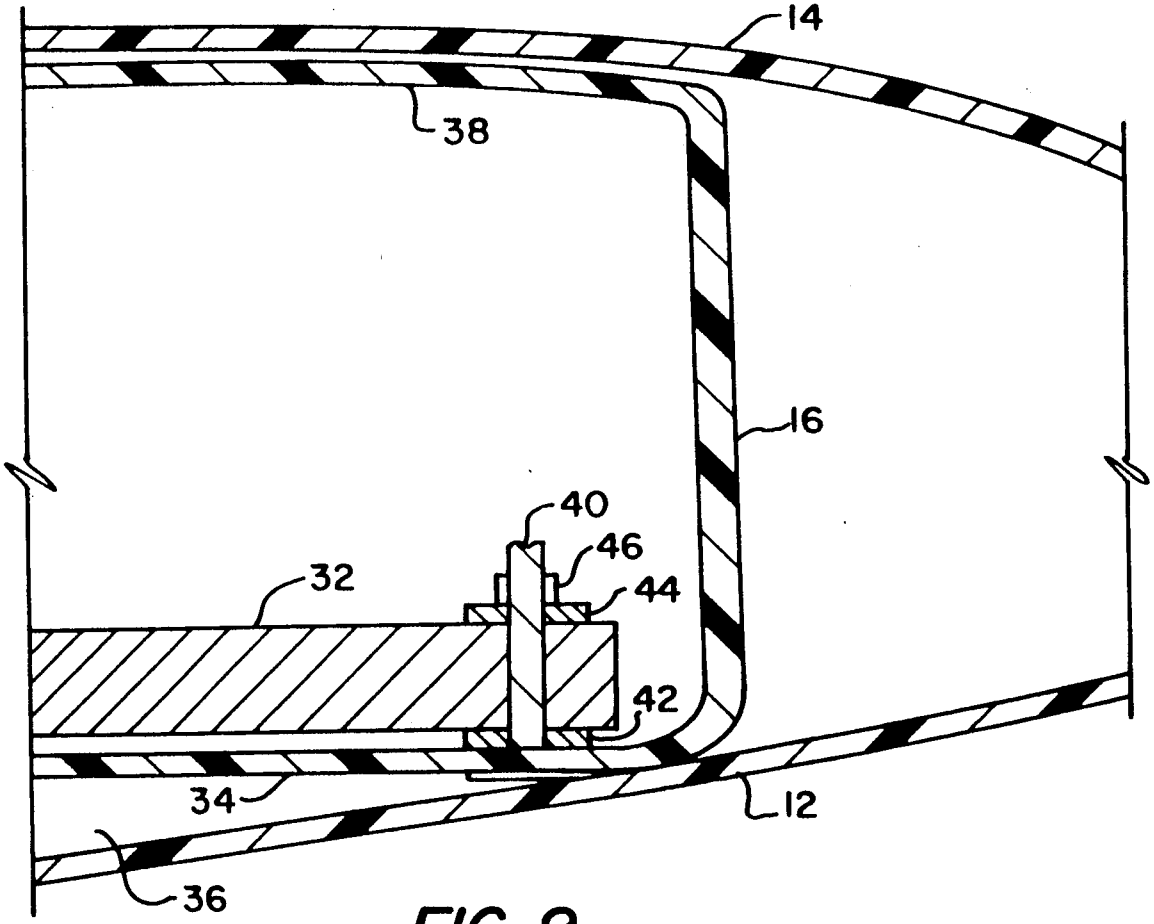
FIG. 9 is a schematic cross-sectional view with parts omitted and parts broken away for clarity illustrating one manner in which an engine frame can be mounted to a girder box provided in accordance with the present invention.

Referring to FIGS. 3, 8 and 9, the aquatic vessel formed in accordance with the present invention has a relatively rigid bottom or hull part 12, a relatively rigid deck part 14 and a girder box 16 which extends longitudinally of the boat fore and aft and is interposed between the deck part and the hull part. The deck part 14 and hull part 12 are fastened to the girder box 16 by, for example, mechanical fasteners although an adhesive may be provided alone or in combination with mechanical fasteners.

As shown, in particular, in FIGS. 3 and 8, the girder box provided in accordance with the present invention must have at least two of the six sides typically associated with a box. Those sides are disposed in a substantially vertical plane and extend fore and aft of the boat. As discussed more fully below with reference to FIGS. 9–13, some or all of the four remaining sides may be common with the functional structures of the boat such as the deck part, the hull part, the transom, and the bow area forward.

One example of a transom structure 18 which can be provided with the boat of the invention is illustrated in FIGS. 3–6. The transom may be formed integrally with or separately from and subsequently attached to the girder box assembly. Of particular note, however, is that the transom 18 must provide a rigid and sturdy attachment structure for the engine where an outboard engine is provided and otherwise must define the after edge of the rigid hull portion which prevents entry of water into the boat. Further, as shown, a drainage hole ("scupper") 20 may be provided so that any fluid inside the boat will be readily exhausted from the boat interior, a so-called self draining feature.

Figure 6:
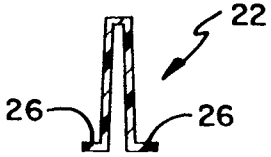
FIG. 6 is an enlarged schematic cross-sectional view taken along lines 6—6 in FIG. 3.
Figure 7:
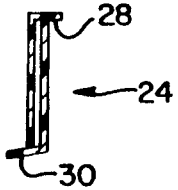
FIG. 7 is a schematic cross-sectional view taken alone line 7—7 in FIG. 3.
Figure 4:
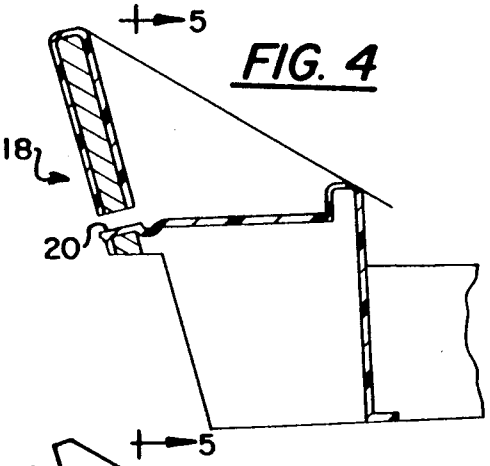
FIG. 4 is an enlarged schematic cross-sectional view taken along lines 4—4 in FIG. 3.

As shown in particular in FIG. 3, a plurality of cross beams 22 may be mounted to and extend between the vertical sides 24 of the girder box 16. Such cross beams 22 maintain the vertical side walls 24 in predetermined spaced relation and transmit forces therebetween as well as define with the vertical sides 24 of the girder box 16 a support structure for an inboard engine and either propeller arrangement or hydrojet, either of which may be provided as an alternative to an outboard motor mounted to a transom structure 18, described above with reference to FIGS. 4 and 5. While the longitudinal sides 24 and cross beams 22 of the girder box 16 may have any desired cross-section, in the illustrated embodiment, the cross beams are inverted U-shaped in cross-section with base flanges 26, as shown in FIG. 6. Furthermore, the longitudinal sides 24 are substantially planar with an upper flange 28 continuous with the tops of the cross beams 22 and a base flange 30 continuous with the base flanges 26 of the cross beams 22. In addition, while the girder box structure 16 can be formed from any suitable material, in the preferred embodiment, the girder box is formed from the same material as or a similar material to the hull and deck parts. Finally, as illustrated, the girder box 16 is generally hollow so that control cables, fuel lines and wires for lighting can be fed therethrough. However, it is to be understood that the girder box structure can be partially or totally filled with a foam material or inflatable bladder to provide supplemental structural support and/or buoyancy.

As shown in FIG. 9, another related advantageous aspect of the girder box 16 provided in accordance with the present invention is that the engine frame 32 which provides support for the engine can be an integral part of the boat subassembly which is the girder box. More particularly, in the embodiment shown in FIG. 9, the girder box 16 has a generally rectilinear cross-section including a generally planar base wall 34 which is spaced from the relatively rigid hull part 12 of the boat. Hull to deck putty may be provided between the planar base wall 34 of the girder box and the hull part 12, as shown schematically at 36. Such hull to deck putty is typically a thermosetting resin matrix within which random cut glass fibers are dispersed. The top wall 38 of the girder box, on the other hand, is secured to the deck part 14 with, for example, mechanical fasteners and/or an adhesive material (not shown) so that a rigid connection is provided therebetween. In order to mount the engine frame 32 to the girder box, studs or bolts 40 which are an integral part of the girder box 16 are provided and extend upwardly from the base wall 34 into the interior of the girder box 16. The engine frame 32 can then be mounted via the studs or bolts 40 to the girder box 16 by inserting the studs or bolts 40 through suitably defined apertures in the engine frame 32. Rubber bushings 42 are preferably mounted between the engine frame 32 and the girder box 16 to cushion the engine frame 32 and hence define a shock absorbing structure. A further rubber bushing 44 is typically mounted atop the engine frame so as to be disposed between a suitable nut and washer or the like 46 and the engine frame 32. The nut and washer assembly 46 secures the engine frame 32 with respect to the stud or bolt 40 and hence with respect to the girder box 16.

Figure 10:
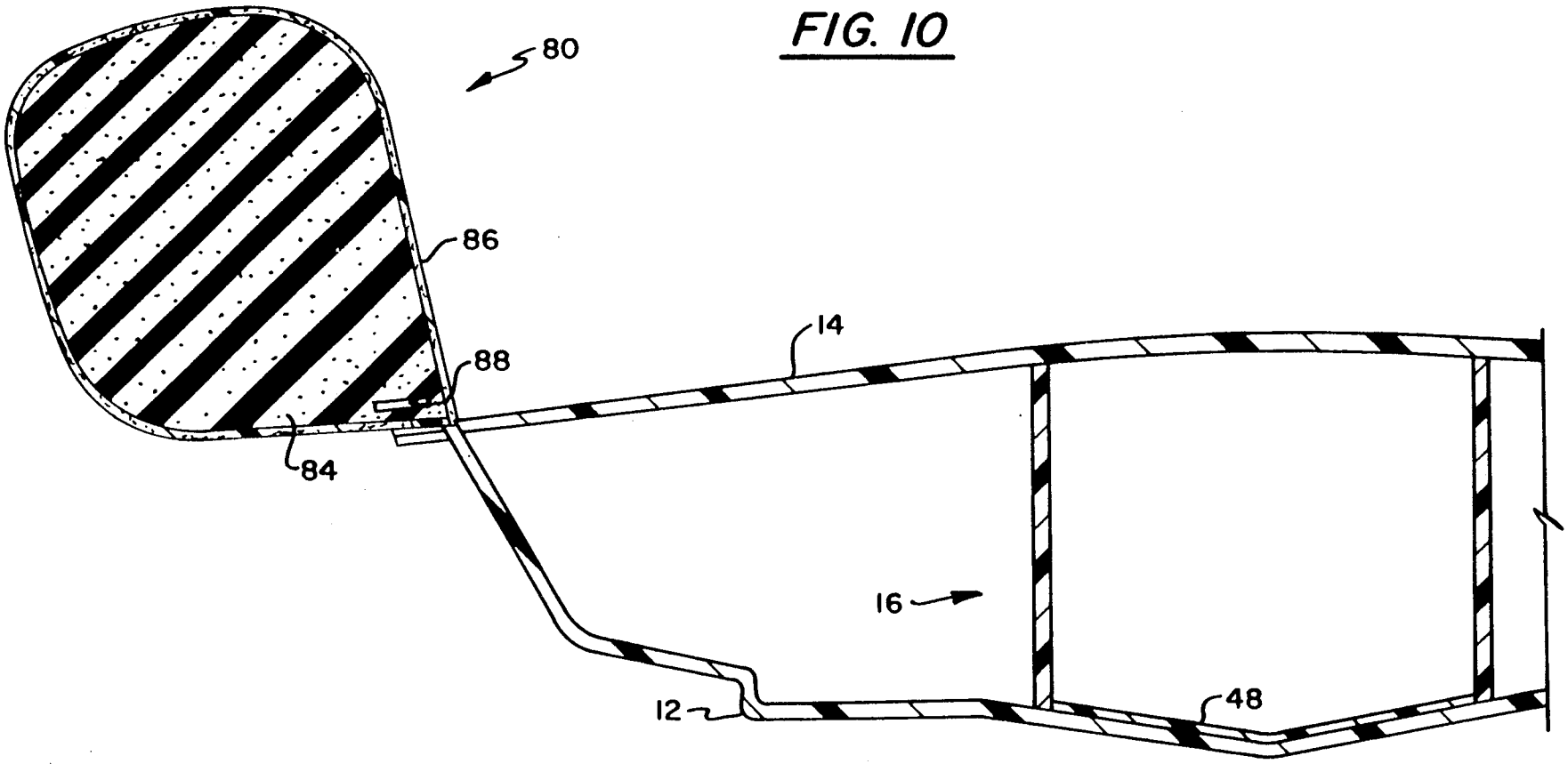
FIG. 10 is a schematic cross-sectional view with parts omitted and parts broken away for clarity of a buoyancy part in accordance with the present invention mounted to the deck and hull parts and illustrating one form of a girder box in accordance with the present invention.

As discussed above with reference to FIG. 9, the girder box can be provided so as to have a substantially rectilinear cross-section and thus include a top wall and a horizontal bottom wall in addition to the longitudinal side walls. In the alternative, as shown in FIG. 10, the girder box 16 can have a bottom wall 48 shaped so as to conform to the shape of the rigid hull part 12. Furthermore, as shown the topside or face of the girder box can be defined by the relatively rigid deck part 14 and thus is common with that functional portion of the boat structure.

Figure 11:
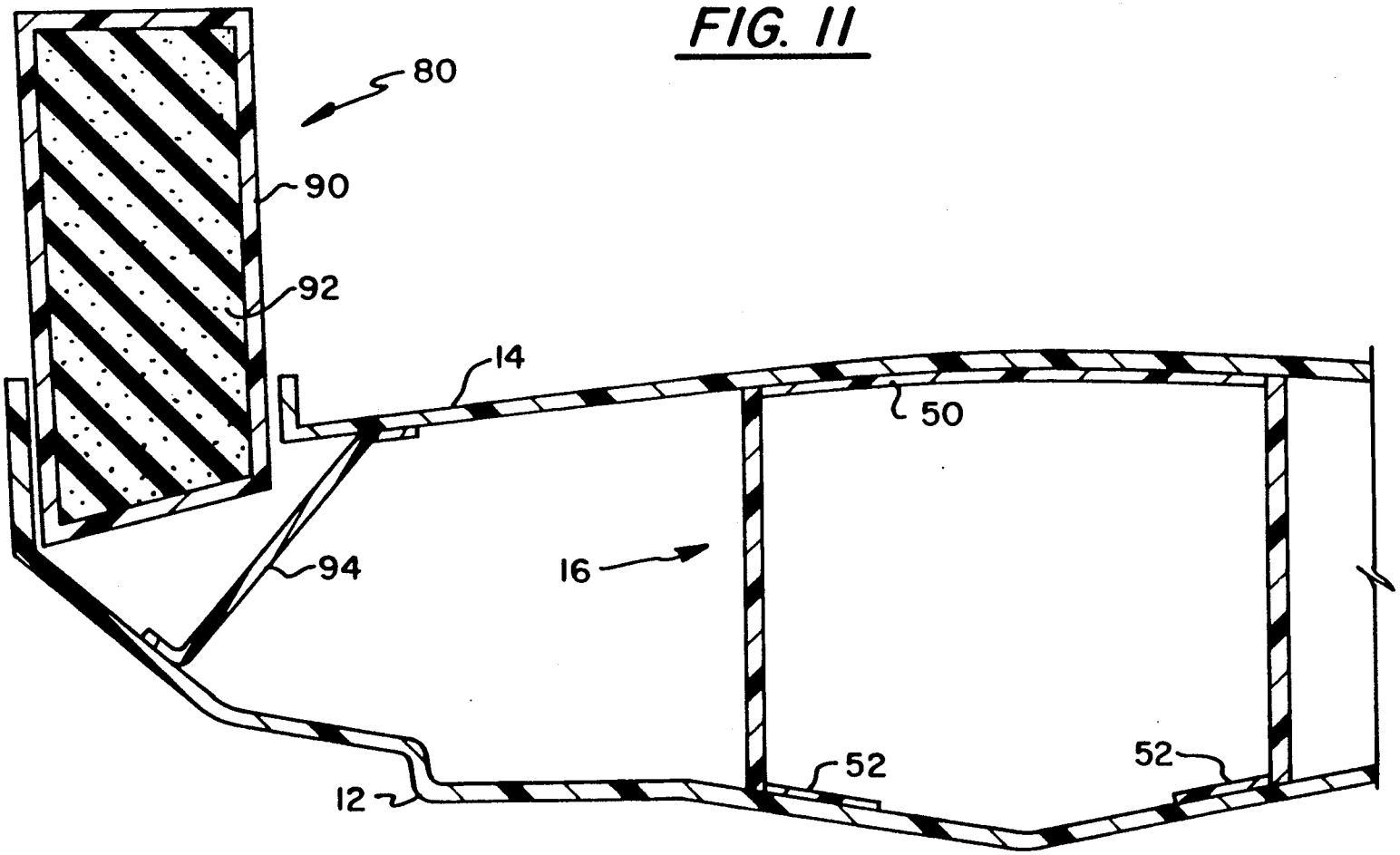
FIG. 11 is a schematic cross-sectional view with parts omitted and parts broken away for clarity of another buoyancy part in accordance with the present invention and showing another alternative girder box configuration in accordance with the present invention.

As shown in FIG. 11, in accordance with a further alternate embodiment of the invention, the girder box 16 can have a top wall 50 disposed in parallel relation to and mounted to the relatively rigid deck part and an incomplete bottom wall which solely provides flange elements 52 enabling interconnection of the hull part 12 and the girder box assembly 16. Such flange elements 52 can be mounted with mechanical fasteners and/or adhesive to the relatively rigid hull part 12.

Figure 12:
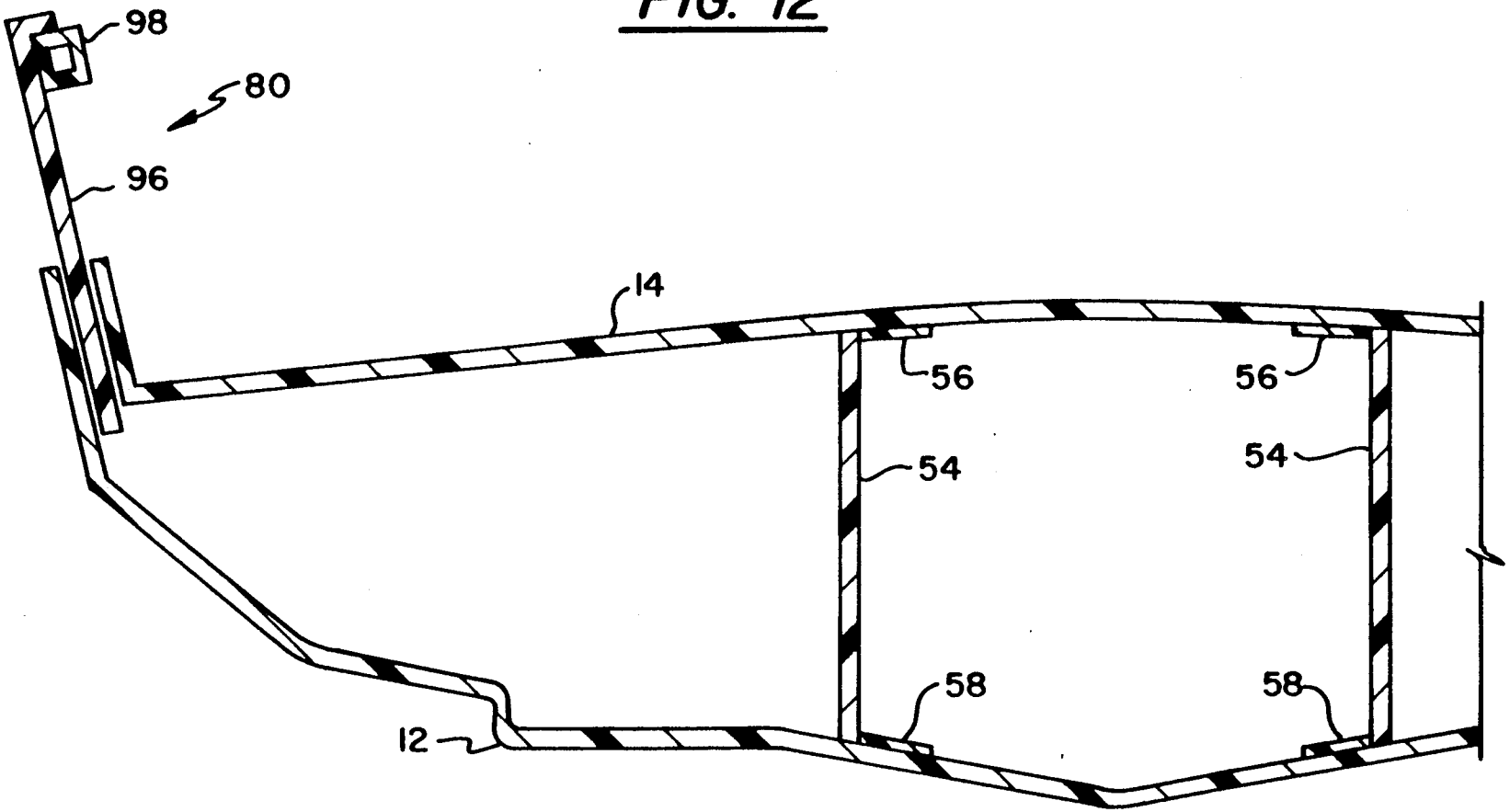
FIG. 12 is a schematic cross-sectional view with parts omitted and parts broken away for clarity of yet a further buoyancy part in accordance with the present invention and illustrating yet another girder box configuration in accordance with the present invention.

In accordance with yet a further alternative embodiment of the invention, as shown in FIG. 12, the girder box 16 can be provided substantially solely with longitudinal side walls 54 with substantially horizontally extending flange elements 56 adjacent the deck part 14 and substantially horizontally extending flange elements 58 along the hull part 12 so as to enable mechanical and/or adhesive fastening of the longitudinal side walls to the deck part and hull part, respectively.

Figure 13:
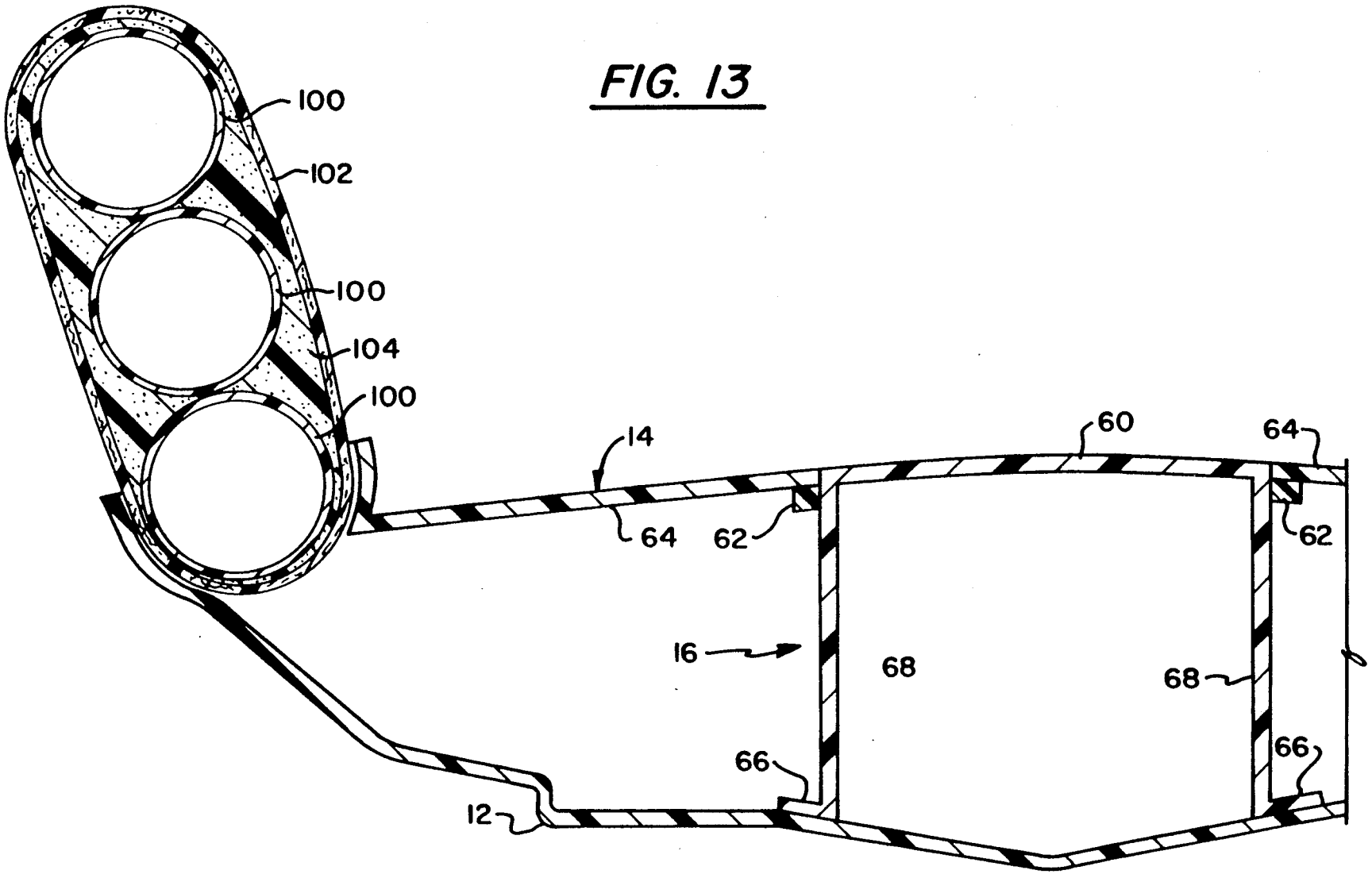
FIG. 13 is a schematic cross-sectional view with parts omitted and parts broken away for clarity of another buoyancy part in accordance with the present invention and showing another girder box structure in accordance with the present invention.

In accordance with another alternative girder box configuration, as shown in FIG. 13, the top wall 60 of the girder box 16 defines a part of the relatively rigid deck part 14. In such a structure, mounting blocks 62 are preferably mounted to each longitudinal side of the girder box 16 to which the truncated deck parts 64 can be mechanically and/or adhesively interconnected. As shown in FIG. 13, substantially horizontally extending flange elements 66 can be provided at the base of the longitudinal side walls 68 to enable mechanical and/or adhesive interconnection of the longitudinal side walls 68 of the girder box to the relatively rigid hull part 12. As noted more particularly below, the deck part can be a cored structure. Indeed, the trend is to form such rigid boat parts from cored material such as balsawood or foam cored material rather than a solid material such as fiberglass, primarily for weight minimization purposes. Similarly, the girder box can be formed from a cored material, particularly when used to define a portion of the deck part as in the embodiment of FIG. 13.

Figure 14:
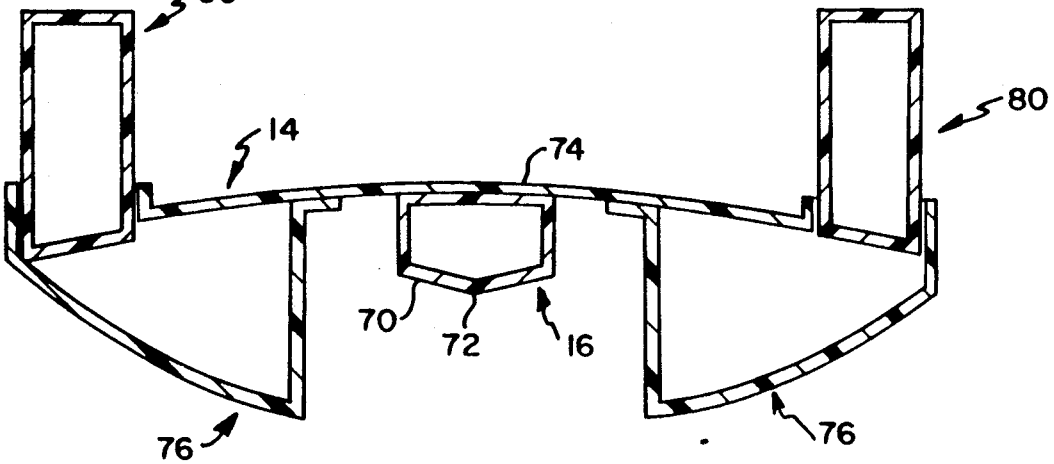
FIG. 14 is a partial, schematic cross-sectional view of another alternate girder box and hull part in accordance with the invention.

Yet a further alternate girder box and hull configuration is shown in FIG. 14. As shown, in this embodiment the girder box 16 is of reduced vertical dimensions, includes a bottom wall 70 having a downwardly directed crest 72 as to deflect fluid should the same come into contact therewith, and a top wall 74 which is mechanically and/or adhesively secured to the relatively rigid deck part. The principal function of the girder box in this embodiment is to provide stiffness to the deck part 14 to prevent deflection of the deck part in response to movement of the boat's occupants and/or the water. In this embodiment the hull part 12 is in fact defined by starboard and port hull portions 76 each of which are suitably attached to the deck part 14 and/or to the buoyancy element 80 at an outermost peripheral edge thereof and mechanically and/or adhesively secured to the rigid deck part adjacent the girder box assembly. Thus, in this embodiment the boat has a double hull, catamaran configuration. While in the illustrated embodiment the starboard and port hull parts are illustrated as indirectly attached to the deck part via the buoyancy element, it is to be understood that each of the hull parts could be connected to a respective peripheral edge of the deck part and the buoyant element secured thereto as described below with reference to FIG. 10. Although not illustrated in detail, the buoyancy elements 78 of FIG. 14 and 15, may be filled with a foam material or balsawood. In the alternative, a buoyant element having any of the configurations illustrated in FIGS. 10–13 could be provided and interconnected to the hull and deck parts.

Figure 15:
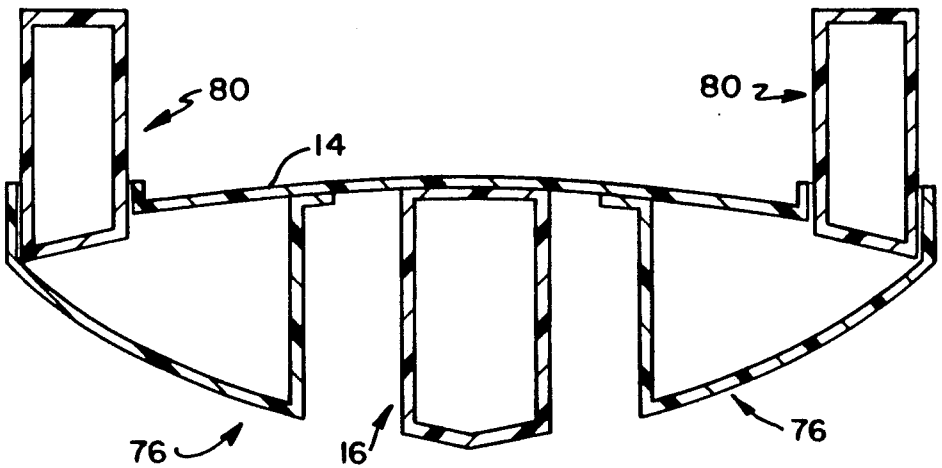
FIG. 15 is a partial schematic cross-sectional view of yet another alternate girder box and hull part in accordance with the invention.

Yet a further girder box configuration in accordance with the present invention is shown in FIG. 15. This configuration is substantially similar to the configuration illustrated in FIG. 14 and described with reference thereto. However, the embodiment of FIG. 15 differs from the embodiment of FIG. 14 in that the girder box is elongated in elevation as compared to the embodiment of FIG. 14 but is defined in spaced relation, from the starboard and port hull parts 76. Thus, the configuration of FIG. 15 defines a trimaran-type hull structure.

Figure 1:
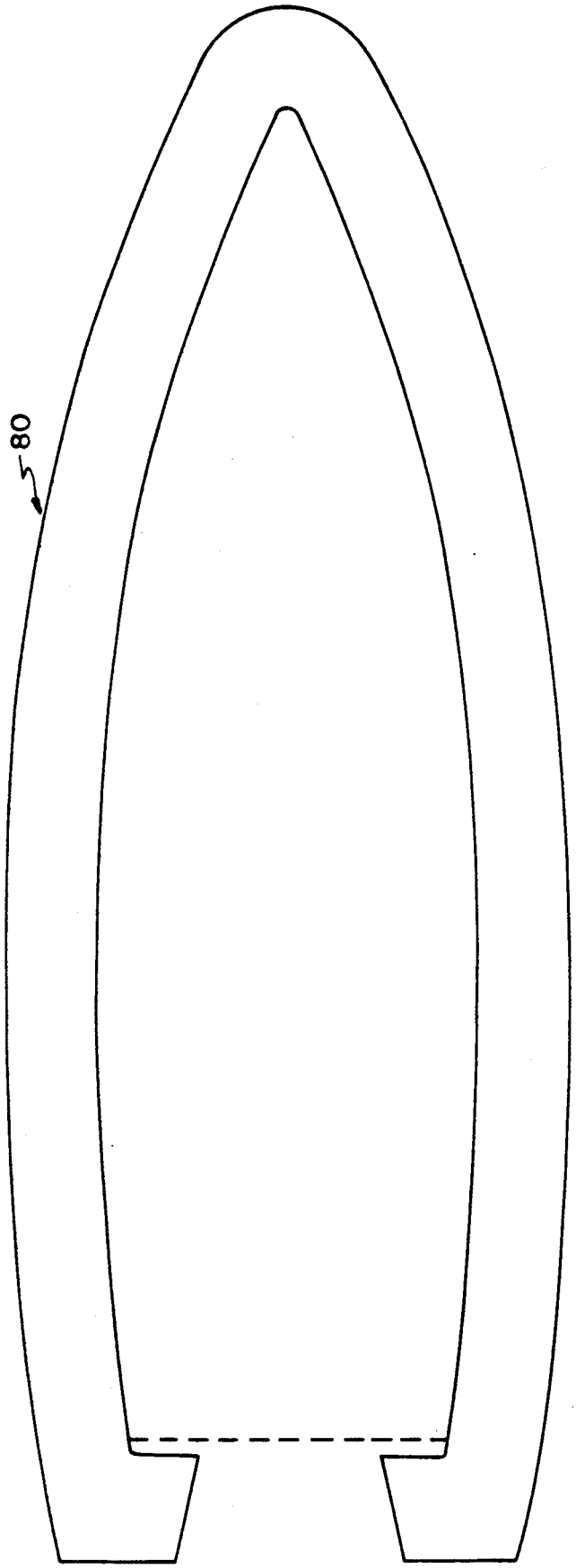
FIG. 1 is a top plan view of a buoyancy part provided in accordance with the present invention.
Figure 2:
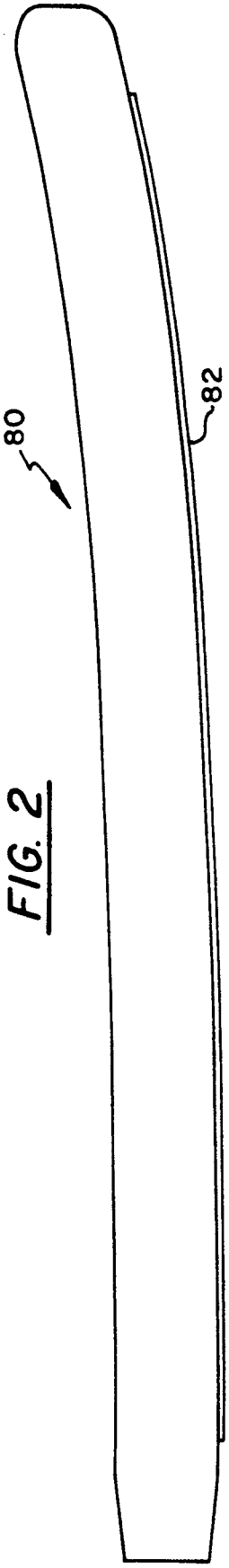
FIG. 2 is a schematic side elevational view of a buoyancy part provided in accordance with the present invention.

As shown in FIGS. 1 and 2, the buoyancy part 80 provided in accordance with the present invention extends along the sides of the vessel fore and aft and substantially about the entire periphery of the boat except in the vicinity of the transom element, if provided. As described more fully below, a flange 82 can be defined on the undersurface of the buoyancy part 80 to facilitate mechanical attachment of the buoyancy part 80 to the hull and deck parts 12,14.

As shown in FIG. 10, in accordance with a first embodiment of the invention, the buoyancy part 80 is formed from a cellular material 84 such as closed cell urethane foam which is preformed into a desired buoyancy part configuration. As schematically shown, a composite skin 86 is preferably provided in surrounding relation to the cellular material 84 which renders the buoyant part usable on boats. More particularly, a composite skin is preferably provided to make the buoyant part 80 resist the harmful effects of the sun, resist puncture and resist abrasion, thereby enhancing the usability of the cellular material on the aquatic vessel of the invention.

As can be seen, the hull part 12 and deck part 14 are interconnected peripherally of the boat at a so-called hull to deck joint. The buoyancy part 80, in the embodiment of FIG. 10, is typically secured to the hull to deck joint by inserting mechanical fasteners (not shown) through the hull to deck joint into the buoyancy part 80. An adhesive material or cement ("bedding compound") is preferably disposed between the hull to deck joint and the buoyancy part or element so that as the mechanical fastener draws the buoyancy element to the hull to deck joint, the cement ensures a fluid tight seal therebetween and maximizes the strength of the mounting joint. A mounting pad as shown schematically at 88 is also preferably preformed within the cellular material 84 for receiving the mechanical fastener to thereby facilitate mechanical attachment of the buoyancy to the hull to deck joint. The mounting pad may be continuous or provided at spaced locations along the length of the buoyant part 80. In addition or in the alternative, a flange 82 can be mounted to the buoyant part, as shown in FIG. 2, to facilitate mechanical attachment of these parts. As a further alternative, although not shown in particular, receivers for the mechanical fasteners can be embedded in the cellular material to facilitate the mechanical attachment of the buoyancy element to the hull and deck parts.

Although the cellular material buoyancy element has been illustrated and described as being mountable to a peripheral hull to deck joint as shown in FIG. 10, it is to be understood that such a buoyancy element can be mounted to the hull and deck parts in any suitable manner including any one of the mounting configurations shown in FIGS. 11–13 and described below with reference thereto. Likewise, the buoyancy parts or elements described below with reference to FIGS. 11–13 can be mounted to the hull and deck parts in any suitable manner including any one of the four mounting configurations illustrated in FIGS. 10–13. Even further, the girder box assemblies illustrated in FIGS. 10-15 may be employed with any of the buoyancy parts or elements illustrated in FIGS. 10-13 and with any of the hull and deck mounting configurations illustrated in those figures.

As shown in FIG. 11, in accordance with another embodiment of the invention, the buoyancy element 80 is hollow, for example of a cored composite construction, as shown at 90. A cellular material or balsa wood 92 may be provided in the center of the cored composite 90. Furthermore, baffles (not shown) may be provided within the interior of the buoyancy element 80 so as to enhance the mechanical strength thereof. A buoyancy element of the type illustrated in FIG. 11 is preferably made off-line and cemented and/or mechanically fastened in place. In the embodiment of FIG. 11, the buoyancy element 80 is mounted directly between the hull and deck parts, hence, no direct hull to deck joint is provided.

In order to minimize the chance of seawater leaking into the gap defined between the hull part and the deck part, as shown in FIG. 11, where no hull to deck joint is provided a baffle 94 or foam or the like can be mounted to and extend between the hull part 12 and the deck part 14 before the buoyancy element 80 is mounted thereto. Thus, in the alternative or additionally, although not shown in particular, the gap between the deck part, the hull part and the girder box can be filled with a foam material.

In accordance with yet a further aspect of the invention, shown in FIG. 12, the buoyancy element 80 is not necessarily formed from material having a specific gravity of less than 1. Thus in the example shown in FIG. 12, the buoyancy element 80 is a substantially planar element 96 which can be formed from ABS with an acrylic skin (not shown in particular) to provide the requisite strength, and sun, puncture and abrasion resistance. The buoyancy element of FIG. 12 is preferably thermoformed and reinforced, if necessary, off-line and is then adhesively and/or mechanically fastened to the hull part 12 and deck part 14. Again, there is no direct hull to deck joint in the mounting assembly shown in FIG. 12. As such, although probably not necessary with the configuration of FIG. 12, a baffle element as shown in FIG. 11 or a foam material can be provided between the hull part and the deck part prior to mounting the buoyancy element thereto. Furthermore, as shown, a box section 98 can be mounted to extend along at least a portion of the length of the planar buoyancy element 96 to provide stiffness to the topside panel.

Again, it is noted that while the relatively resilient resin topside illustrated in FIG. 12 is not ordinarily considered to be a "buoyant" material as it does not possess a specific gravity of less than 1, it performs the buoyancy function of preventing entry of water into the interior of the boat. As such, it is buoyancy element in accordance with the invention.

Yet a further embodiment of the invention is shown in FIG. 13. In this embodiment, the topsides or buoyancy part 80 is formed from a plurality of hollow cylinders 100, three in the illustrated embodiment. The hollow cylinders can be formed from, for example, curved tubes of polyvinyl chloride (PVC) piping. Although in the illustrated embodiment the cylinders 100 are of the same diameter, the diameters of the cylinders can be different from one another and more or fewer cylinders than are shown could be provided.

The vertically lowermost cylinder is mechanically and/or adhesively secured to the hull part 12 and to the deck part 14. Vertically adjacent cylinders 100 are mechanically and/or adhesively secured to a next adjacent cylinder. In addition or in the alternative, a shroud element 102 which extends along at least a portion and preferably the entire length of the cylinders can bind or encase the cylinders, as shown. The shroud can completely surround the cylinders or can simply extend from the deck part 14 around the cylinders to the hull part 12. Surrounding the cylinders as shown provides a smooth interior for the boat structure and therefore not only enhances the structural integrity of the topsides but is aesthetically pleasing.

As yet a further alternative, as shown, the gap between the cylinders 100 and the shroud 102 can be filled with a foam material 104 to further enhance the structural and functional advantages of this embodiment.

Again, because no hull to deck joint is defined peripherally of the vessel, in order to ensure fluid is prevented from entering the gap between the hull part and the deck part, a baffle element as shown in FIG. 11 or a foam material can be provided between the hull and deck parts.

As is further apparent from the drawing figures, the structure of the present invention includes a deck part which can be defined above the water level and thus the vessel may be a self-draining structure. Accordingly, the present invention enables and facilitates making the system self-bailing because of the dimensional relationships which the maker can control.

As noted above, it is to be understood that the combinations of buoyancy element, buoyancy element attachment configurations, and girder boxes shown in FIGS. 10–15 are not to be considered limiting or exclusive as each structure could be used alone or in combination with others of the shown structures. Indeed, numerous alternative combinations of the structure shown in FIGS. 10–15 could be provided without departing from the invention. It should be noted, furthermore, that in accordance with the invention, the buoyancy part can have virtually any cross-sectional shape, the particular size and shape being substantially a matter of designer/-builder choice.

Although not shown in particular in the schematic cross-sectional views of FIGS. 9–15, the deck part provided in accordance with the present invention is preferably formed from a cored glass-fiber reinforced, thermo-setting plastic laminate. Likewise, the hull part can be formed from a glass-fiber reinforced, thermo-setting plastic, cored or uncored.

Because a girder box is provided in accordance with the present invention, a single hull part can be used in a boat for outboard engines with or without a gravity-bailing/draining deck and/or in an inboard engine or hydrojet boat with or without a gravity-bailing/self-draining deck. Further, in accordance with the invention, a single deck part which is self-draining/self-bailing can be used in both a boat with an outboard engine, and a boat with an inboard engine. Because engines can be premounted off-line into/onto girder boxes in accordance with the invention as described with reference to FIG. 9, a single assembly method/line can be used for outboard or inboard engines, with or without self-bailing decks and the buoyancy elements can be finished on or off-line.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A boat having a hull and comprising:

a hull part disposed generally at and below the water level of the hull;

a deck part extending longitudinally at least a substantial portion of the length of the hull part and transversely at least a substantial portion of the width of the hull part;

a girder box means provided along the longitudinal axis of the boat and mounted between said deck part and said hull part, said girder box means having first and second longitudinally extending side walls, said side walls extending longitudinally along at least a substantial portion of the length of the hull portion, said side walls being laterally spaced from an outer peripheral edge of said hull part and from an outer peripheral edge of said deck part; and a topside part disposed generally at and above the water level of the hull, said topside part defining ar relatively resilient buoyancy part for minimizing fluid entry into said boat;

a peripheral edge of said deck part being laterally spaced from a peripheral edge of said hull part to define a gap therebetween along at least a substantial portion of said peripheral edges, said buoyancy part being disposed in said gap between said hull and deck parts and being at least one of mechanically and adhesively secured to each of said hull and deck parts.

2. A boat as in claim 1, wherein said girder box means further comprises a top wall, said top wall extending in parallel relation to at least a part of said deck part and being at least one of mechanically and adhesively fastened thereto.

3. A boat as in claim 1, wherein said girder box means further comprises a bottom wall, said bottom all being disposed in parallel spaced relation to said hull part, said bottom wall being at least one of adhesively and mechanically attached to said hull part.

4. A boat as in claim 1, wherein said girder box means further comprises a bottom wall, said bottom wall being disposed in a plane extending substantially perpendicularly to said side walls of said girder box, at least a portion of said bottom wall of said girder box being spaced from said hull part.

5. A boat as in claim 4 further comprising a resinous material disposed between said girder box bottom wall and said hull part.

6. A boat as in claim 4, further comprising an engine frame for supporting an engine rigidly mounted to said girder box bottom wall.

7. A boat as in claim 1, wherein said girder box means further includes a top wall, said deck part being defined at least in part by said top wall of said girder box.

8. A boat as in claim 1, wherein said buoyancy part comprises an elongate member formed from a closed cell foam material.

9. A boat as in claim 8 further comprising a skin of protective material defined circumferentially of said closed cell material, said material being resistant to puncture, abrasion and ultraviolet rays.

10. A boat as in claim 9, wherein said closed cell material is closed cell urethane foam and wherein said skin is formed from a fiber reinforced resin.

11. A boat as in claim 1, wherein said buoyancy part is formed from a composite material so as to have a hollow interior, said hollow interior being filled with one of a cellular material and balsa wood.

12. A boat as in claim 1 further comprising a baffle element mounted to and extending between said deck part and said hull part adjacent the outer peripheral edge of said hull part.

13. A boat as in claim 1, wherein said buoyancy part is formed from a substantially planar, solid resinous element, said element being mounted to and between said peripheral edges of said hull part and said deck part and extending vertically upwardly therefrom.

14. A boat as in claim 13, further comprising a means mounted to said buoyancy part for stiffening said buoyancy part along at least a portion of the length thereof.

15. A boat as in claim 13, wherein said buoyancy element is formed from ABS with an acrylic skin.

16. A boat as in claim 1, wherein said buoyancy part comprises a plurality of longitudinally disposed hollow tubular members, a vertically lowermost of said hollow tubular members being at least one of mechanically and adhesively secured to said hull part and to said deck part.

17. A boat as in claim 16, wherein three hollow tubular members are provided, said tubular members being longitudinally secured to one another and mounted in vertically adjacent relation so as to define a topside extending substantially vertically upwardly from the outer peripheral edge of said hull part.

18. A boat as in claim 16, further comprising a shroud element mounted in surrounding relation to at least a portion of said plurality of tubular members and extending along at least a portion of the length thereof.

19. A boat as in claim 18, further comprising a foam material disposed between said shroud and said tubular members.

20. A boat having a hull and comprising:

a hull part disposed generally at and below the water level of the hull;

a deck part extending longitudinally at least a substantial portion of the length of the hull part and transversely at least a substantial portion of the width of the hull part;

a girder box means provided along the longitudinal axis of the boat and mounted between said deck part and said hull part, said girder box means having first and second longitudinally extending side walls, said side walls extending longitudinally along at least a substantial portion of the length of the hull portion, said side walls being laterally spaced from an outer peripheral edge of said hull part and from an outer peripheral edge of said deck part; and a topside part disposed generally at and above the water level of the hull, said topside part defining a relatively resilient buoyancy part for minimizing fluid entry into said boat; said hull part being fixedly mounted to said deck part along the outer peripheral edge of said hull part and said buoyancy part being at least one of mechanically and adhesively fastened to each of said fixedly mounted hull and deck parts.

21. A boat having a hull and comprising:

a hull part disposed generally at and below the water level of the hull;

a deck part extending longitudinally at least a substantial portion of the length of the hull part and transversely at least a substantial portion of the width of the hull part, said hull part comprising starboard and port hull portions, each of said hull portions being operatively coupled along a peripheral edge thereof to said deck part;

a girder box means provided along the longitudinal axis of the boat and mounted to said deck part, said girder box means having first and second longitudinally extending side walls, said side walls extending longitudinally along at least a substantial portion of the length of the hull portion, said side walls being laterally spaced from an outer peripheral edge of said hull part and from an outer peripheral edge of said deck part; and a topside part disposed generally at and above the water level of the hull, said topside part defining a relatively resilient buoyancy part for minimizing fluid entry into said boat;

a peripheral edge of said deck part being laterally spaced from a peripheral edge of said hull part to define a gap therebetween along at least a substantial portion of said peripheral edges, said buoyancy part being disposed in said gap between said hull and deck parts and being at least one of mechanically and adhesively secured to each of said hull and deck parts.

22. A boat as in claim 21, wherein said girder box means is laterally spaced and inboard from each of said hull portions and has a maximum vertical height less than a maximum vertical height of said hull portions.

23. A boat as in claim 21, wherein said girder box means is laterally spaced and inboard from each of said hull portions and has a maximum vertical height greater than a maximum vertical height of said hull portions.

24. A boat having a hull and comprising, in combination:

a first module including a deck part and a hull part, said deck part extending longitudinally at least a substantial portion of the length of the hull part and transversely at least a substantial portion of the width of the hull part;

girder box means for mounting said deck part to said hull part and for transmitting forces therebetween and along the length of the boat, said girder box means including the first and second longitudinally extending side walls; and a buoyancy module positioned to generally define a ring around said hull generally at and above the water level of the hull, said buoyancy module comprising a relatively resilient buoyancy element extending vertically upwardly from a peripheral side edge of said first module;

a peripheral edge of said deck part being laterally spaced from a peripheral edge of said hull part to define a gap therebetween along at least a substantial portion of said peripheral edges, said buoyancy element being disposed in said gap between said hull and deck parts and being at least one of mechanically and adhesively secured to each of said hull and deck parts.

25. A boat as in claim 24, wherein said girder box means further comprises a plurality of cross beam members mounted to and extending between said longitudinally extending side walls.

26. A boat as in claim 24, wherein said girder box means further comprises a substantially horizontal base wall and wherein an engine frame is fixedly mounted to said horizontal base wall so as to define support for an engine inboard as an integral part of the girder box means.

* * * * *